US011638945B2

(12) United States Patent
Faupel et al.

(10) Patent No.: US 11,638,945 B2
(45) Date of Patent: May 2, 2023

(54) TRUING MACHINE AND METHOD FOR MAGNESIUM COMPONENTS

(71) Applicant: Magnesium Products of America Inc., Eaton Rapids, MI (US)

(72) Inventors: Tom Faupel, Mason, MI (US); Craig Feltenbarger, Eaton Rapids, MI (US)

(73) Assignee: MAGNESIUM PRODUCTS OF AMERICA, INC., Eaton Rapids, MI (US)

( * ) Notice: Subject to any disclaimer, the term of this patent is extended or adjusted under 35 U.S.C. 154(b) by 791 days.

(21) Appl. No.: 15/380,511

(22) Filed: Dec. 15, 2016

(65) Prior Publication Data

US 2017/0173654 A1 Jun. 22, 2017

Related U.S. Application Data

(60) Provisional application No. 62/269,749, filed on Dec. 18, 2015.

(51) Int. Cl.
*B21D 1/00* (2006.01)
*B21D 1/12* (2006.01)
(Continued)

(52) U.S. Cl.
CPC ..... *B21D 1/12* (2013.01); *B21D 1/00* (2013.01); *B21D 1/14* (2013.01); *B21D 22/02* (2013.01); *B21D 53/88* (2013.01); *B21D 35/005* (2013.01)

(58) Field of Classification Search
CPC ... B21D 1/10; B21D 1/12; B21D 1/14; B21D 3/14; B21D 53/88; B21D 22/02; B21D 31/005; B21D 1/06
See application file for complete search history.

(56) References Cited

U.S. PATENT DOCUMENTS 5,257,526 A * 11/1993 Teixeria ..... B21D 1/14 72/457
5,623,846 A 4/1997 Brewer, Jr.
(Continued)

FOREIGN PATENT DOCUMENTS

CN 102019318 A 4/2011
CN 102500672 A 6/2012
(Continued)

OTHER PUBLICATIONS

Extended European Search Report issued in corresponding U.S. Appl. No. 16/204,251 dated May 19, 2017.
(Continued)

*Primary Examiner* — Debra M Sullivan
(74) *Attorney, Agent, or Firm* — Foley & Lardner LLP

(57) ABSTRACT

A machine for bending a casted or stamped component into compliance with dimension and tolerance requirements, includes a base and at least one fixed holding device coupled to the base and configured to hold a corresponding datum of the component. The machine further includes at least one bending device coupled to the base and configured to engage a corresponding bending datum of the component, and a control system configured to control the at least one fixed holding device and the at least one bending device during a manipulation routine. The at least one fixed holding device is configured to hold the component in a predetermined spatial orientation relative to the base. The at least one bending device is configured to plastically deform the component.

16 Claims, 4 Drawing Sheets

(51) Int. Cl.

| | |
|---|---|
| ***B21D 1/14*** | (2006.01) |
| ***B21D 22/02*** | (2006.01) |
| ***B21D 53/88*** | (2006.01) |
| *B21D 35/00* | (2006.01) |

(56) References Cited

U.S. PATENT DOCUMENTS

| | | | | |
|---|---|---|---|---|
| 5,644,854 | A * | 7/1997 | Bergeron | B21D 1/14 33/288 |
| 2012/0024034 | A1* | 2/2012 | Ren | B21D 5/01 72/362 |
| 2014/0208817 | A1* | 7/2014 | Dai | B21D 1/06 72/19.7 |
| 2015/0260508 | A1* | 9/2015 | Cagle | G01B 11/02 356/601 |

FOREIGN PATENT DOCUMENTS

| | | | | |
|---|---|---|---|---|
| CN | 102910212 | A | | 2/2013 |
| CN | 103567257 | A | | 2/2014 |
| CN | 103667842 | A | | 3/2014 |
| CN | 104550231 | A | | 4/2015 |
| CN | 104785576 | A | * | 7/2015 |
| DE | 10014741 | | | 8/2001 |
| FR | 2492302 | A1 | | 4/1982 |
| GB | 2 019 573 | A | | 10/1979 |
| JP | 2004042136 | | | 2/2004 |

OTHER PUBLICATIONS

Third Office Action issued in connection with MX Appl. Ser. No. MX/a/2016/016861 dated Jun. 17, 2022, English translation only (2 pages).

* cited by examiner

TRUING MACHINE AND METHOD FOR MAGNESIUM COMPONENTS

CROSS-REFERENCE TO RELATED PATENT APPLICATIONS

This application claims the benefit of and priority to U.S. Provisional Patent Application No. 62/269,749, filed Dec. 18, 2015. U.S. Provisional Patent Application No. 62/269,749 is incorporated by reference herein in its entirety.

SUMMARY

One embodiment relates to a machine for bending a cast or stamped component into compliance with dimension and tolerance requirements, the machine including a base and at least one fixed holding device coupled to the base and configured to hold a corresponding datum of the component. The machine further includes at least one bending device coupled to the base and configured to engage a corresponding bending datum of the component, and a control system configured to control the at least one fixed holding device and the at least one bending device during a manipulation routine. The at least one fixed holding device is configured to hold the component in a predetermined spatial orientation relative to the base. The at least one bending device is configured to plastically deform the component.

Another embodiment relates to a method of truing a stamped or cast component for a vehicle, the method including receiving the component in a truing machine and holding the component at first, second, and third datums with first, second, and third holding devices, respectively, in a known spatial orientation. The method further includes measuring with at least one measurement device, at least one of a fourth datum of the component or a bending location of the component. The method further includes evaluating measurements from the at least one measurement device for compliance with predetermined dimensional requirements. The method further includes determining, based on the measurements, a manipulation routine, and performing the manipulation routine configured to bring the component within the dimensional requirements.

BACKGROUND

To meet federal vehicle regulations and consumer preferences for ever-increasing fuel economy, vehicle manufacturers seek to reduce vehicle weight, while still satisfying various other, potentially competing regulations (e.g., safety) and consumer preferences (e.g., cost and quality). One manner by which vehicle manufacturers may reduce vehicle weight is by replacing vehicle components made from traditional materials (e.g., steel) with components made from other lighter weight materials (e.g., aluminum or magnesium and alloys thereof) with the biggest weight savings achieved by replacing heavier and/or larger components. With these new and/or larger-format applications of lighter materials, vehicle manufacturers and especially suppliers are being challenged with producing vehicle components in compliance with component dimension and tolerance requirements. For example, casting or stamping large-format magnesium (e.g., magnesium-alloy) components (e.g., vehicle lift gate frame or internal structure) may produce cast or stamped components that are warped relative to the vehicle manufacturer's dimension and tolerance requirements.

DETAILED DESCRIPTION

According to an exemplary embodiment, manufacturing equipment and processes are provided to produce a cast or stamped magnesium component in compliance with a manufacturer's dimension and tolerance requirements. The manufacturing equipment and processes contemplated herein generally include a post-forming or stamping truing machine and process, which holds and bends, at various locations or regions, a magnesium component that is initially warped (i.e., after casting or stamping, has a static form outside the vehicle manufacturer's dimension and tolerance requirements) to become trued (i.e., after truing has a static form that is within the manufacturer's requirements). More specifically, and as discussed in further detail below, the equipment and processes require holding a component in a fixed, known orientation and applying forces at various locations of the component to bend the component into compliance with the manufacturer's requirements.

The manufacturing equipment and process may also include casting or stamping equipment/processes (e.g., molds or dies, etc., and related processes for forming the component), other post-forming equipment/processes (e.g., machining and/or attachment equipment and processes, for example, to create apertures or other features with greater precision than possible during the casting or stamping processes), and/or line transport equipment/processes (e.g., to move components from a moving assembly line or other location to and/from the truing machine).

Figure 1:
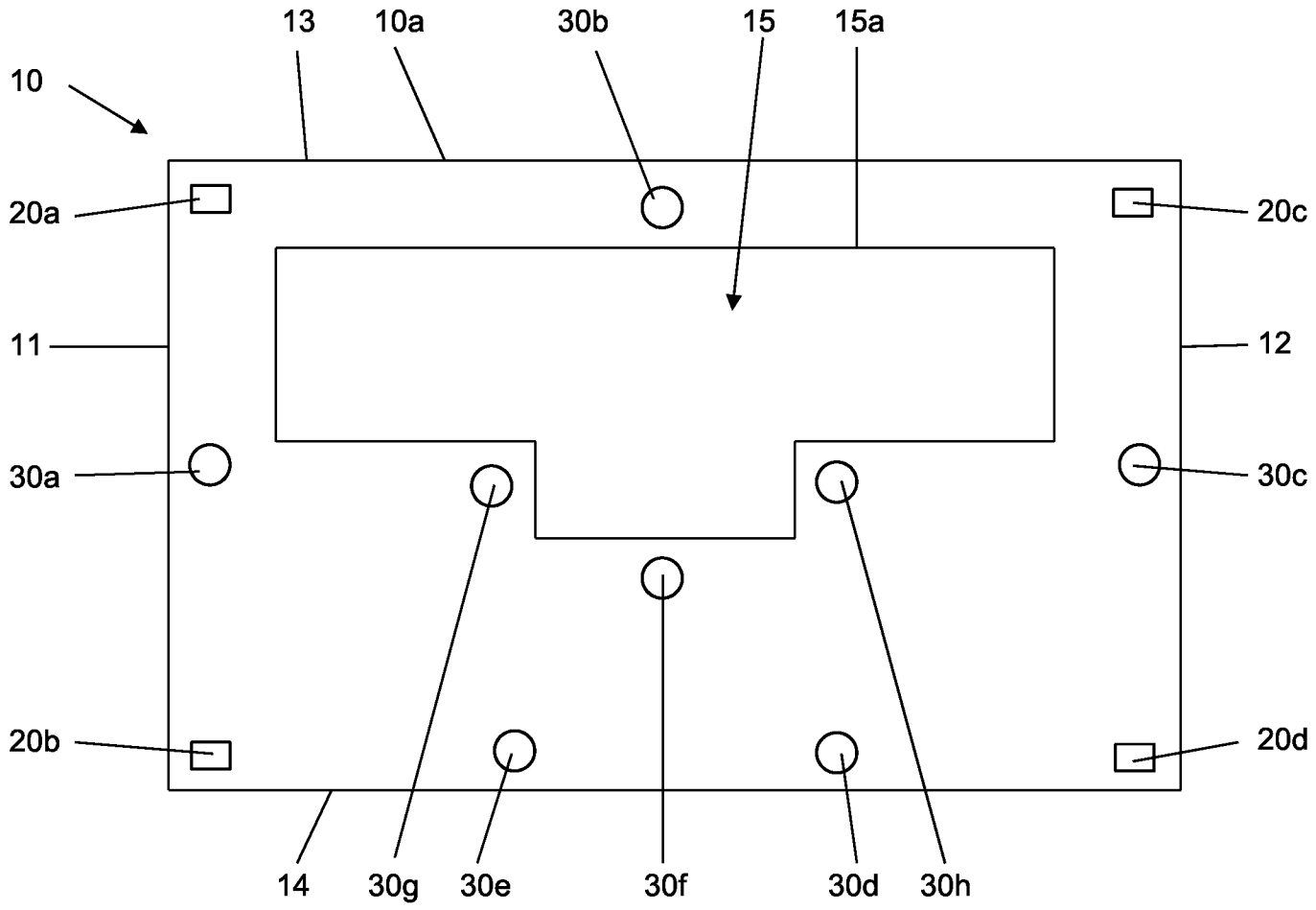
FIG. 1 is a top plan view of a vehicle component shown in the form of a magnesium lift gate for a vehicle.
Figure 2:
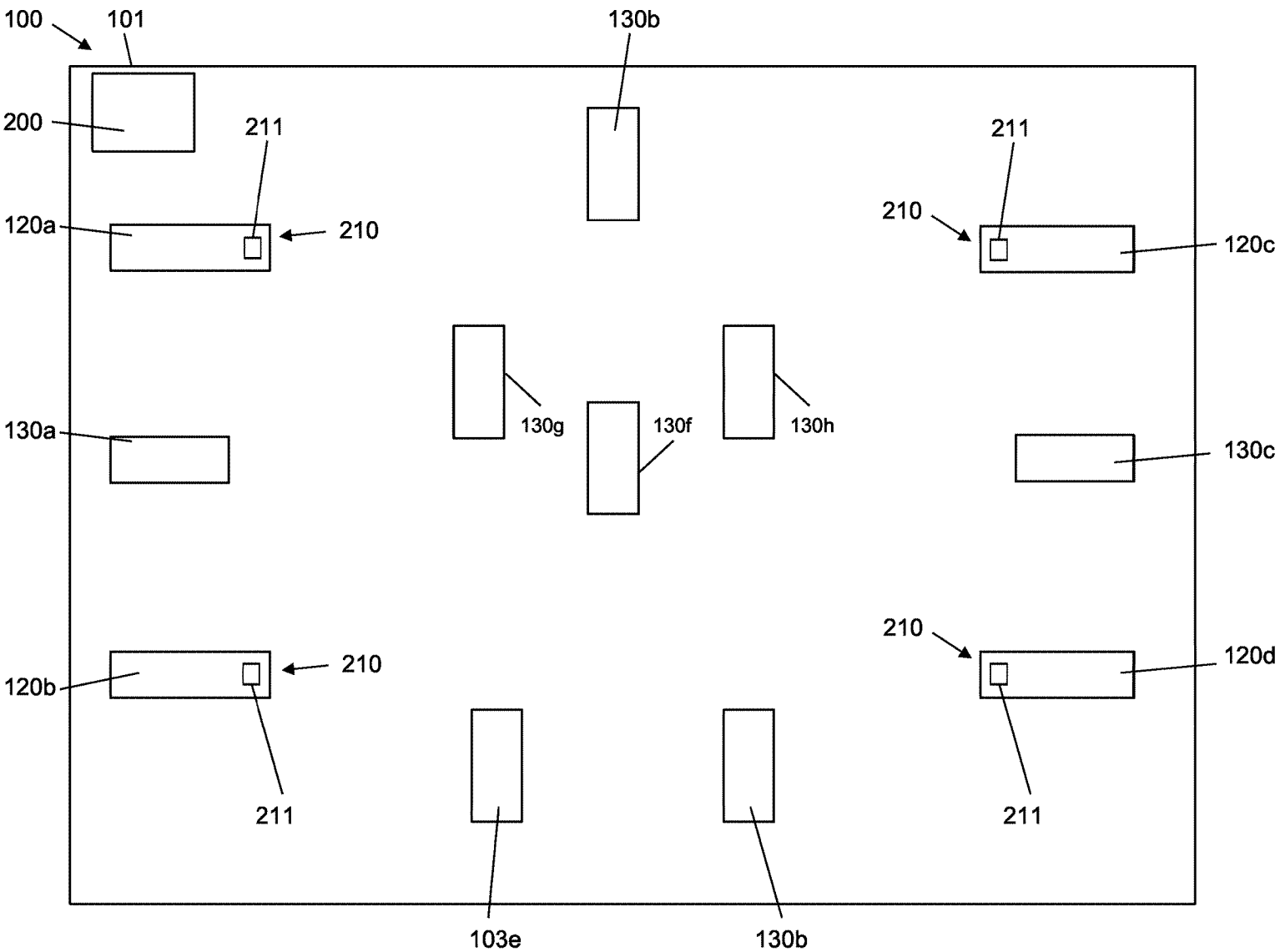
FIG. 2 is a plan view of a truing machine according to an exemplary embodiment.

With reference to FIGS. 1 and 2, as an example, the component 10 (depicted schematically) may be a magnesium lift gate frame for a vehicle, which forms an internal structure of a lift gate assembly to provide various structural properties to the lift gate assembly (e.g., crash energy absorption, attachment points and features, etc.). The lift gate frame has a generally rectangular periphery 10*a* (i.e., having predominant left 11, right 12, upper 13, and lower 14 edges or sides) and is generally flat, albeit with a three-dimensional profile (e.g., various protrusions, recesses, varying thickness, etc. for structural, attachment, and various other functional and/or aesthetic purposes). For example, the lift gate frame may include various recesses, protrusions, and/or other curvatures but still be relatively flat with all surfaces of the lift gate frame being within a few inches (e.g., +/− approximately 5 inches) or a relatively small distance (e.g., +/− approximately 20% of a maximum distance between left 11 and right 12, or top 13 and bottom 14, sides of the lift gate frame) of a single plane passing through the lift gate. The lift gate frame may also include a central large aperture 15 (e.g., to accommodate a rear window of a vehicle). The aperture 15 may have a generally continuous inner periphery 15*a* (e.g., having a predominant concave curvature relative to a center of the aperture 15), or may include, as shown, protrusions extending toward the center of the aperture 15 (e.g., the aperture periphery 15 having features with a convex curvature protruding toward the center of the aperture).

While the equipment and processes are discussed herein both generically and with respect to cast or stamped magnesium vehicle lift gate frames, it is contemplated that such equipment and processes are also applicable to other materials having similar manufacturing challenges or properties (e.g., casting or stamping properties, such as warping, for example, with aluminum), other types of vehicle components (e.g., structure, frame, or panel for doors, roof, hoods, body panels, etc.), other shapes and profiles (e.g., other peripheral shapes, greater/lesser three-dimensional profiles, etc.), and other product categories (e.g., non-automotive components).

Figure 3:
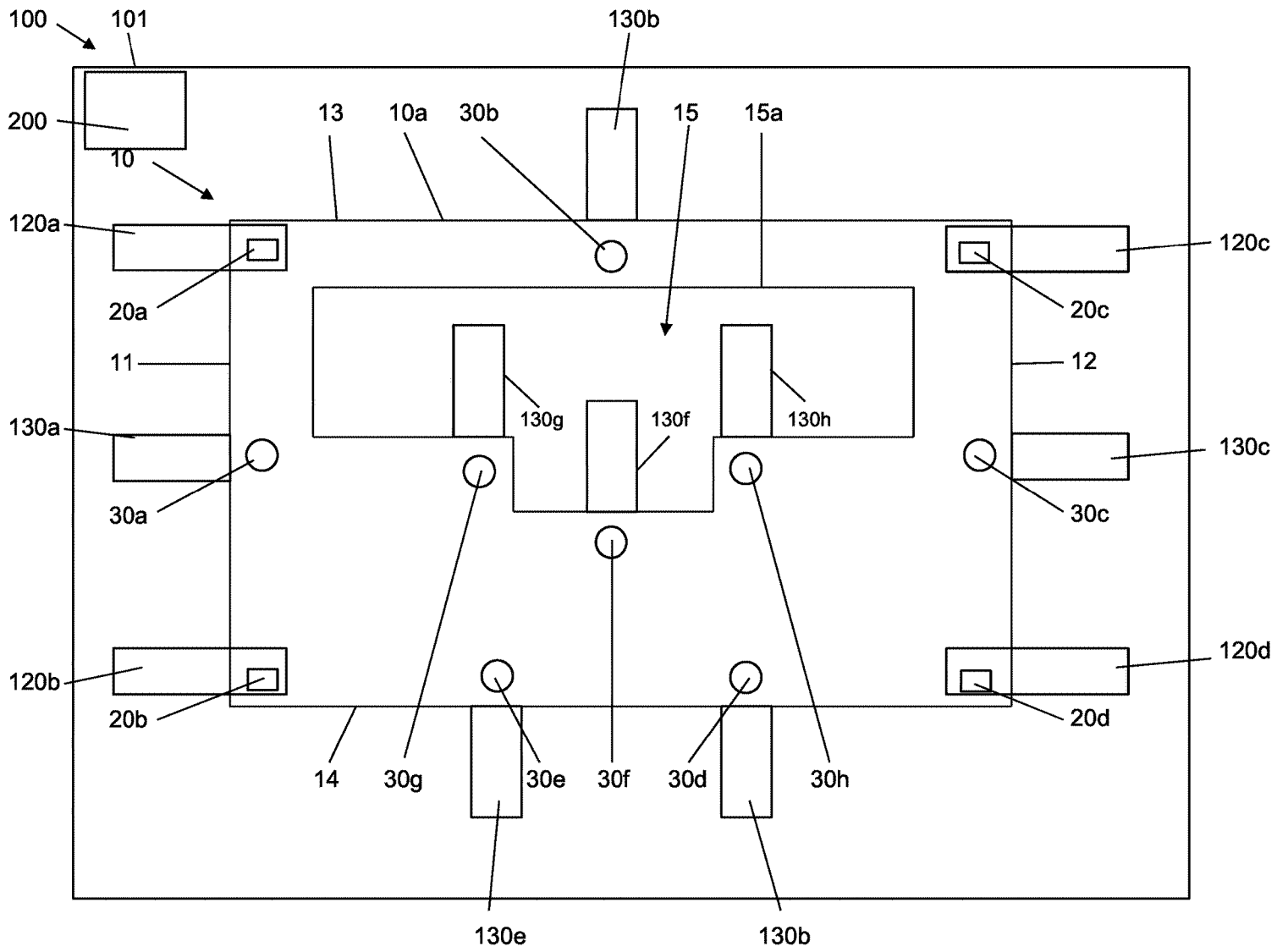
FIG. 3 is another plan view of a truing machine having a vehicle component provided thereon according to an exemplary embodiment.

The truing machine 100 is configured to receive the component 10, hold the component 10 at various locations, evaluate the component 10, and apply forces at various locations about the component 10 to bring the component 10 into compliance with the manufacturer's dimension and tolerance requirements. As discussed in further detail below with respect to FIG. 3, the truing machine 100 generally includes a plurality (i.e., series, at least one, etc.) of holding or clamping devices 120 to receive and hold (i.e., secure, engage, clamp, etc.) the component 10, a plurality (i.e., series, at least one, etc.) of manipulation or bending devices 130 that apply a force to bend the component 10, and a control system 200 that evaluates each component 10 and controls the holding devices 120 and/or the bending devices 130 to manipulate or bend the component 10 into compliance with the manufacturer's dimension and tolerance requirements.

In order to receive and hold the component 10, the truing machine 100 is configured as a fixture having a table (i.e., base) 101 including a plurality of holding devices 120 that receive and hold the component 10 at various locations. For example, the truing machine 100 may include holding devices 120*a*, 120*b*, 120*c*, and 120*d*, which are configured to receive and hold the component 10 at various datums 20 (i.e., datum or reference points or locations) of the component 10. Each holding device 120 may either be a fixed holding device (e.g., 120*a*, 120*b*, 120*c*) that is configured to hold the component 10 at a corresponding datum 20 initially and continuously throughout a manipulation process in a predetermined position (i.e., X-, Y-, and Z-axes coordinates relative to the table 101 or other fixed component of the truing machine 100), or the holding device 120 may be a bending (i.e., articulating, manipulating, moving, etc.) holding device (e.g., 120*d*) that moves a corresponding datum 20 (i.e., articulating datum 20*d*) relative to the fixed holding devices to a target location (e.g., bending the component 10 to within the manufacturer's requirements) and thereafter holds the datum 20 at the target location through the reminder of the manipulation process. The fixed holding devices 120 may, for example, include a bottom member that is fixed to the table 101 so as to receive a corresponding datum 20 of the component 10 in the predetermined location, or may otherwise be configured to hold the datum 20 to the predetermined location prior to the manipulation or bending process (e.g., the fixed holding devices may grab and move the component 10 with the datums 20 moving to an initial predetermined orientation). To hold the component 10, each holding device 120 may be include gripping or clamping tools (e.g., clamps, grips, pads, etc.) that grip or compress the component 10 at the datum 20. Movement and actuation of the holding devices 120 (e.g., for gripping/holding, or to move the component 10 into position) may occur through the use of servo motors, pneumatic actuation, hydraulic actuation, and/or any other suitable method or means.

By holding the three datums 20*a*, 20*b*, and 20*c* with the three fixed holding devices 120*a*, 120*b*, 120*c*, respectively, the truing machine 100 fixes the datums 20*a*, 20*b*, 20*c* into a known spatial relationship (i.e., a known plane) with little or no deformation (e.g., elastic or plastic) of the component 10. This advantageously allows for the control system 200 to both evaluate the component 10 relative to the manufacturer's dimension and tolerance requirements within a known spatial coordinate system, and thereafter apply forces to bend the component 10 in a precise manner. It should be noted that while three fixed holding devices 120*a*, 120*b*, 120*c* and one bending holding device 120*d* are shown and described, it is contemplated that more or fewer of either type of holding device 120 may be included.

The truing machine 100 also includes a plurality (i.e., at least one, series, etc.) of manipulation or bending devices 130, which are configured to engage and apply a force against a portion of the component 10, so as to manipulate or bend the component 10 into compliance with the manufacturer's dimension and tolerance requirements. In contrast to the holding devices 120, which are configured to receive and hold the datums 20 in fixed positions during the duration of the bending or manipulation process, the bending devices 130 are configured to engage the component 10 at bending locations 30 (e.g., region, portion, location, etc.) only for a limited time that is less than the duration of the entire bending process. For example, after the component 10 is received by the holding devices 120 and while the component 10 is held by the holding devices 120, a first bending device 130*a* applies and releases a force against a first bending location 30*a* of the component 10, then a second bending device 130*b* applies and releases another force against a second bending location 30*b* of the component 10, and so on (depending on the number of bending devices 130 and bending locations 30). That is, the bending devices 130*a* and 130*b* may operate sequentially, or according to other firing or actuation sequences as described in further detail below.

The bending devices 130 are generally positioned at locations of the table or fixture 101 of the truing machine 100 proximate to the corresponding bending location. The portions of each bending device 130 are configured to move relative to the table 101 so as to avoid obstructing the component 10 as it is moved (e.g., placed onto and removed from the truing machine 100) and so as to engage component 10 at bending locations 30. For example, the bending devices 130 may be configured for portions thereof to move generally horizontally (e.g., in X- and or Y-axes, or within approximately 25 degrees of a horizontal plane) to avoid obstructing the component 10 during placement and removal thereof and to engage or disengage the component 10. Further, the bending devices 130 may be configured to move generally upward and downward (e.g., in the Z-axis, or within approximately 25 degrees of vertical), so as to engage and apply a bending force against the corresponding bending location 30 of the component 10. In order to apply either an upward or downward force, the bending device 130 may include static or actuable tools or fittings to grasp an edge (e.g., of the inner or outer periphery 10*a*, 15*a* of the component 10), so as to pull upward on the component 10 (i.e., to apply an upward force) and/or push downward on the component 10 (i.e., to apply a downward force).

Individual bending devices 130 may be provided for each bending location 30 identified for applying force thereto to bend the component 10 into compliance with the manufacturer's dimension and tolerance requirements. For example, one or more bending devices 130 may be provided along the outer periphery 10*a* of the component 10 between the holding devices 130, which are configured to apply a generally vertical force against the component 10 at bending locations (e.g., 30*a*, 30*b*, 30*c*, 30*d*, and 30*e*) along the outer peripheral edge (e.g., within approximately 4 inches of the edge of the outer periphery 10*a*) of the component 10. One or more additional bending devices 130 may be provided along the inner periphery 15*a* of the component 10 (i.e., within approximately 4 inches of the edge of the inner periphery 15*a*), so as to apply a generally vertical force against a bending location 30*f* on an inner portion of the component 10 and/or against bending locations 30*g*, 30*h* corresponding to protrusions of the component 10 extending toward a center of the aperture 15.

The truing machine 100 also includes a control system 200 that is configured to evaluate each component 10 and control the holding devices 120 and the bending devices 130. That is, the control system 200 controls the truing machine 100 to execute a method for evaluating and manipulating the component 10 into compliance with the manufacturer's dimension and tolerance requirements.

To evaluate each component, the truing machine 100 includes a measurement system 210 that includes a plurality (i.e., at least one, series, etc.) of measurement devices 211 configured to measure the component 10 at predetermined locations, such as at datums 20 (i.e., where the holding devices 120 engage the component 10) and at bending positions 30 (i.e., where the bending devices 130 engage the component 10). The measurement devices 211 may each be laser-based and configured to measure a location of one of more of the datums 20 and/or regions 30 of the component 10 having an accuracy of at least 0.1 mm. For example, the measurement devices 211 may measure a vertical position (i.e., Z-axis position) of the datums 20 and/or the regions 30 of each component 10 held by the holding devices 120 within a fixed coordinate system (e.g., defined relative to the fixture or table 101 of the truing machine 10). The measurement devices 211 may, for example, be provided with each of the holding devices 120 and/or bending devices, for example, by being coupled directly thereto or provided as part of an assembly therewith. According to other exemplary embodiments, the measurement devices may be another type of measurement device (e.g., other optical or force-based measurement devices), have lesser or greater accuracy, measure other position parameters (e.g., X- and Y-axis positions), be provided in other manners (e.g., standalone and/or separate from the holding devices 120 and/or bending devices 130), be provided in different numbers (e.g., 1:1 ratio with the datums 20 and/or regions 30, etc.), provided in a lesser or greater number than the datums 20 and/or regions 30, and/or be provided with different capabilities (e.g., to measure multiple different datums 20 and/or regions 30, including regions that do not correspond holding devices 120 or bending devices 130). It should additionally be noted that for datums 20 corresponding to fixed holding devices 120 (i.e., those that hold datums 20 in a predetermined relationship relative to the table 101 of the truing machine 100), the location of the datums 20 of the component 10 are already known, such that measurements for those datums 20 may not be required.

The control system 200 collects measurements of the component 10 from the measurement system 210 and then evaluates the component 10 to determine whether it is in compliance with the manufacturer's dimension and tolerance requirements. For example, the control system 200 may compare each measurement (e.g., the Z-axis measurement at each datum 20 or bending location 30) to a manufacturer's specification (e.g., within a range, for example +/−2.0 mm) for such a location on the component 10 (e.g., as compared to a perfect or model component). If the component 10 satisfies the manufacturer's requirements, the component 10 is removed from the truing machine 10 for use in a vehicle assembly. If the component 10 does not satisfy the manufacturer's requirements, as discussed in further detail below, the control system 200 determines a manipulation routine according to which the control system 200 moves the holding devices 120 and/or bending devices 130 to manipulate or bend the component 10 into conformity with the manufacturer's requirements. After executing the manipulation routine, the control system 200 then evaluates the component 10 (i.e., takes measurements using the measurement system 210) a second time to assess whether the component 10 satisfies the manufacturer's requirements. If compliant, the component 10 is removed from the truing machine for use in a vehicle assembly. If non-compliant, the control system 200 determines, based on the measurements, and executes a second manipulation routine, then evaluates the component a third and final time to assess whether the component 10 satisfies the manufacturer's requirements. If compliant, the component 10 is removed for use in a vehicle assembly. If non-compliant after executing the second manipulation routine, the component 10 is discarded. According to other exemplary embodiments, the control system 200 may assess and execute a manipulation routine more or fewer times prior to discarding non-compliant components 10, for example, depending on throughput and scrap requirements or targets.

If, based on a first or second assessment, the component 10 is non-compliant with the manufacturer's requirements, the control system 200 determines a manipulation routine for manipulating or bending the specific component 10 with the holding devices 120 and/or the bending devices 130. Each specific manipulation routine may be based, in part, on modeled data (e.g., finite element analyses and simulations of bending non-compliant computer models of components) and collected manufacturing data (e.g., trends observed or assessed for a lot or run of parts). Each manipulation may be defined by various parameters, including total location displacement or position (i.e., total movement of the datum 20 and/or bending location 30, or the holding device 120 and/or bending device 130, when actuated), force application (i.e., the manner by which the holding devices 120 and/or bending devices 130 engage and apply force to the component 10), and firing sequence (e.g., order and/or synchrony of holding devices 120 and/or bending devices 130 applying force at the datums 20 and/or bending locations 30 to bend the component 10).

Regarding the total displacement parameter, each manipulation routine as determined by the control system 200 includes a total displacement parameter for each datum 20 and/or bending location 30 of the component 10 at which the truing machine 100 (i.e., the holding devices 120 and/or bending device 130) applies a force for bending the component 10. More specifically, since the component 10 is held and fixed at datums 20 by several (e.g., three or four) holding devices 120 in known spatial locations (i.e., relative to the fixture or table 101 of the truing machine 100), each manipulation routine includes a total displacement parameter for each other datum 20 (i.e., datums 20 not yet held in a known position) or bending location 30 to which the corresponding holding device 120 or bending device 130 moves such datum 20 or bending location 30 of the component 10 (e.g., by applying a generally vertical force). Due to elasticity and plasticity of the material forming the cast or stamped component 10, the total displacement parameter may be greater than a distance between the measured position of the datum 20 or bending location 30 and the manufacturer's requirements, such that the holding device 120 or bending device 130 moves or displaces the datum 20 or bending location 30 beyond (i.e., past or further than) the manufacturer's component requirements (i.e., the component 10 is not coined or forced just to the manufacturer's component requirements and no further). That is, the total displacement parameter is configured to provide additional displacement to provide sufficient plastic deformation of the component 10, such that when force is released from the datum 20 or bending location 30, the component 10 relaxes (i.e., due to material elasticity) into a static position within the manufacturer's requirements. For example, if a given bending location is +2.0 mm out of specification (e.g., in the Z-axis), the total displacement parameter may be −6.0 mm, such that the bending device 130 moves the bending location 30 by −6.0 mm (i.e., downward in the Z-axis), which is 4.0 mm past the manufacturer's requirements. Thereafter, when the force against the bending location 30 is removed, the component 10 relaxes to a static condition with the bending location 30 moving to with the manufacturer's requirements. Additionally, because plastically moving one or more datums 20 and/or bending locations 30 in different sequences may plastically move another datum 20 and/or bending location 30 in different manners, each total displacement parameter may be determined within the overall manipulation or bending routine and not in isolation of other total displacement parameters or firing sequence. Furthermore, the firing sequence and resultant prior plastic deformation may result in that the datum 20 and/or bending location 30 of the component 10 being displaced after measurement but prior to the associated bending device 130 applying a force thereto. As such, it may be advantageous to define the total displacement parameter or position, as a final position in real space (i.e., relative to the table 101) or as a delta relative to the originally measured position.

Regarding the force application, the manipulation routine may provide stepped displacement and/or include a ramp up, hold, and ramp down periods for displacing the each datum 20 and/or bending location 30 to the total displacement position. For stepped displacement, rather than having the holding device 120 or bending device 130 necessarily move the datum 20 or bending location 30 to the final displacement parameter or position in one step (i.e., continuous motion or operation), the datum 20 or bending location 30 is first moved only a portion of the total displacement, then the applied force is lessened or removed entirely so as to allow the component 10 to relax partially or completely, before reapplying a force to move the datum 20 or bending location 30 further toward the total displacement position. For example, if the total displacement parameter for a bending location 30 is −10.0 mm (i.e., downward in the Z-axis) and the step distance is 2.0 mm, the bending device 130 may first move the bending location to −2.0 mm (i.e., downward in the Z-axis), then lessen the force (e.g., to allow the component 10 to fully or partially relax), then move the bending location to −4.0 mm, then lessen the force, the move the bending location to −6.0 mm, and so on until the −10.0 total displacement parameter is achieved. The force is then removed and the component 10 allowed to relax into a static position.

For ramped displacement, the holding devices 120 and/or bending devices 130 may move at different rates for engaging, moving, and disengaging the component 10. For example, during ramp up period, the holding device 120 or bending device 130 may initially move at a relatively slow rate (i.e., distance per unit time, such as mm/s), so as to engage and/or initially move the datum 20 or bending location 30 of the component 10 relatively slowly and then gradually increase its speed over a displacement period (e.g., 0.1 seconds) during which the datum 20 or bending location 30 is moved to its total displacement position or to its stepped position (i.e., when stepped and ramped displacement are combined). Having an initially slow movement rate may, for example, avoid engaging the component at too high a rate of speed, especially if the firing sequence caused prior plastic deformation and moved the given datum 20 or bending location 30 from its originally measured position. During the hold period, the holding device 120 or bending device 130 may hold each datum or bending location 30 of the component 10 at the total displacement parameter for limited hold period or duration (e.g., 0.05 seconds). During the ramp down period, the holding device 120 or bending device 130 moves away from the total displacement parameter or position at an initially relatively fast speed and then gradually decrease over the total ramp down movement period (e.g., 0.1 seconds). According to other exemplary embodiments, the ramp up, hold, and ramp down periods may be configured differently, for example, by having longer or shorter durations, having a constant movement rate, having movement rates determined according to measured forces (as opposed to time), etc.

As noted above, the firing sequence (i.e., the sequence in which the holding devices 120 and/or the bending devices 130 engage and displace the datums 20 and/or bending locations 30) causes plastic deformation of component 10 in a sequential manner. The firing or actuation sequence may be configured in various different manners with various different parameters, including simultaneous firing or actuation of none, some, or all holding devices 120 and/or bending devices 130, and firing in a spatially continuous or disrupted sequence (i.e., actuating in sequence, or not, around the inner or out perimeters 10*a*, 15*a* of the component 10).

For any bending holding devices (e.g., 120*d*), which are configured to move and bend the component 10 and thereafter hold the component 10 at a corresponding datum 20*d*, the bending routine may include actuating the bending holding device 120*d* prior to any bending devices 130, which bend but do not hold the component 10. In the bending routing, any bending holding device 120*d* will engage the component 10 at the corresponding datum 20*d* and apply a force thereto to displace the datum 20*d* to its determined maximum displacement position (e.g., with or without stepped and/or ramped displacement). The applied force is then lessened or removed to allow the component 10 to relax to allow the datum 20*d* to move to and be held in a fixed position with the manufacturer's requirements for the remainder of the bending routine. Alternatively, the bending holding device 120*d* may be configured to actively move the datum 20*d* to within the manufacturer's requirements (i.e., as opposed to such movement occurring through elasticity of the component 10).

Additionally, control system 200 may be configured to determine and execute the manipulation routine in its entirety (e.g., moving all bending holding devices 120*d* and all bending devices 130) before reevaluating the component. That is, the control system 200 does not reevaluate or react after movement of individual or a subset of bending holding devices 120*d* and/or bending devices 130. According to other exemplary embodiments, remeasure, reevaluate, and react by redetermining or reconfiguring a manipulation routine more granularly after moving one or a larger subset of the bending holding devices 120*d* and/or bending devices 130.

While the truing machine 100, including its holding devices 120, bending devices 130, and control system 200, are discussed in broad terms above, following is a description of an exemplary embodiment of a truing machine 100 with reference to the component 10 and a method of bending or truing the component 10 with the truing machine 100 into compliance with a manufacturer's dimension and tolerance requirements.

Figure 4:
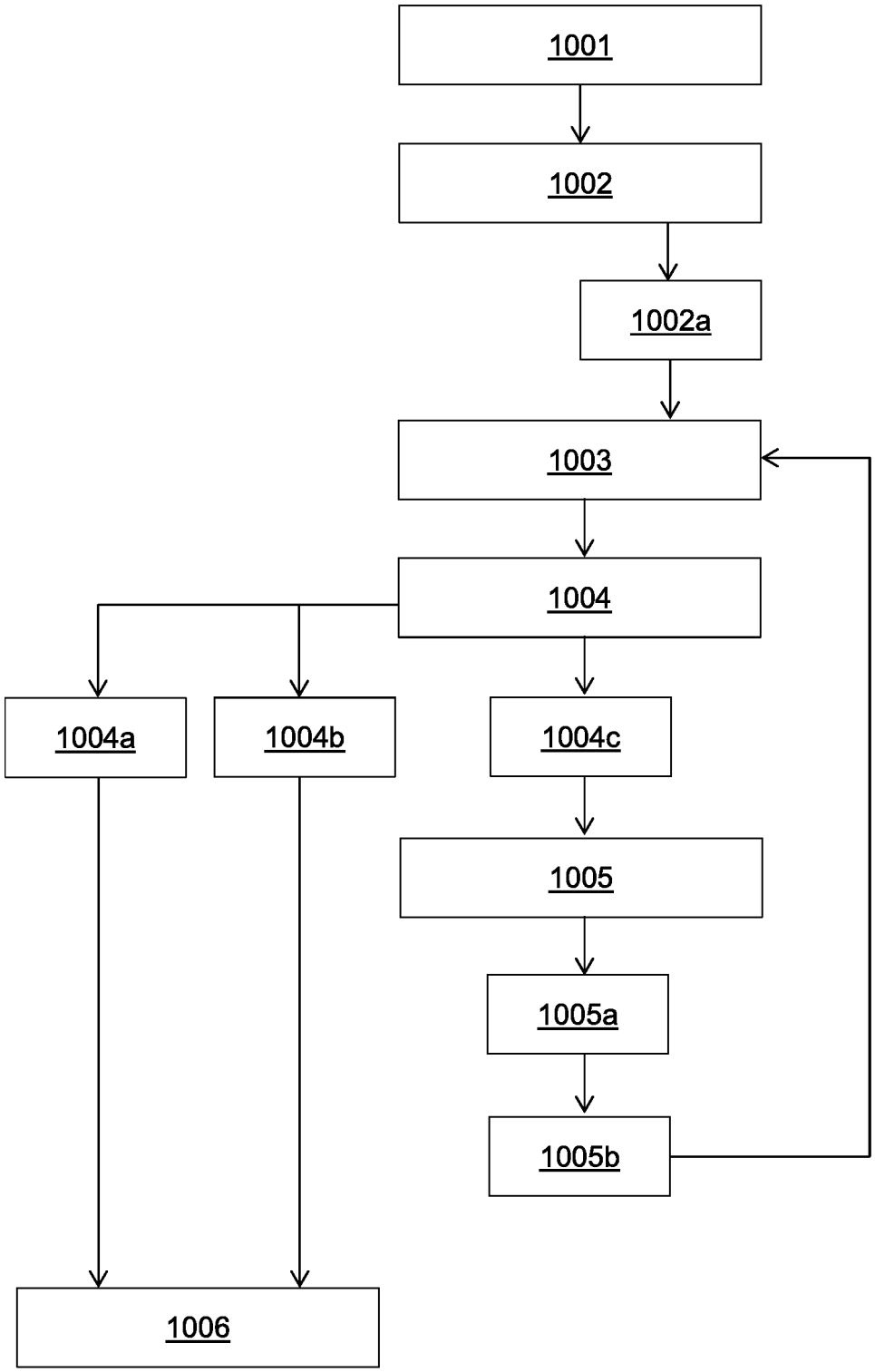
FIG. 4 is a flow diagram showing a method of truing a component according to an exemplary embodiment.

Referring now to FIG. 4, according to an exemplary embodiment, the truing machine 100 as described above includes an associated method configured for truing a component 10 that is a cast or stamped magnesium lift gate frame. The truing machine 100 includes four holding devices 120*a*, 120*b*, 120*c*, and 120*d*, which correspond to four datums 20*a*, 20*b*, 20*c*, and 20*d*, respectively, of the component 20. Three of the holding devices 120*a*, 120*b*, and 120*c* are each configured as fixed holding devices, which prior to and through any bending process, hold the datums 20*a*, 20*b*, 20*c* in a predetermined relationship (i.e., in a known relationship relative to the table 101 of the truing machine). The fourth holding device 120*d* is configured as a bending holding device, which as part of the manipulation process will first bend the component 10, and thereafter hold the component 10 at datum 20*d* for the remaining duration of the bending process or routine.

The truing machine 100 also includes at least five bending devices 130, which include at least one bending device 130*a*, 130*b*, 130*c*, and 130*d* positioned between the holding devices 120*a*, 120*b*, 120*c*, and 120*d* outside along an outer periphery of the component 10, and include at least one bending device 130*f* positioned within the outer periphery of the component 10 (e.g., through aperture 15) so as to engage an interior peripheral portion of the component 10.

In a first step 1001, the truing machine 100 receives a component 10, for example, from a robotic arm that moves the component 10 from a moving conveyer or other source.

In a second step 1002, the fixed holding devices 120*a*, 120*b*, 120*c* begin hold the component 10 at at least the three corresponding datums 20*a*, 20*b*, and 20*c* in the known spatial orientation (i.e., the known plane defined by the predetermined locations of the datums 20*a*, 20*b*, and 20*c* in the holding devices 120*a*, 120*b*, 120*c* at fixed X-, Y-, and Z-positions). The component 10 may either be received in the predetermined orientation during the first step 1001, or as part of the second step, for example as substep 1002*a*, be moved into the known spatial orientation).

In a third step 1003, the control system 200, by way of its measurement system or devices, measures the component 10, for example, by determining a vertical height (e.g., Z-axis position) at each non-held datum (e.g., datum 20*d*) and each bending location 30.

In a fourth step 1004, the control system 200 evaluates the component 10 by comparing one or more of the measurements obtained in step 1003 to the manufacturer's requirements, determines whether the component 10 is in compliance (e.g., if all measurements are within the manufacturer's requirements), and decides how to handle the component.

In a first substep 1004*a*, if the component 10 is in compliance, the control system 200 accepts the component 10.

In a second substep 1004*b*, if the component 10 is non-compliant and has already undergone a threshold number of manipulation or bending processes (e.g., preferably two processes), the control system 200 discards the component 10.

In a third substep 1004*c*, if the component is non-compliant and has not already undergone the threshold number of manipulation or bending processes (e.g., the component 10 has not yet undergone and/or has undergone only one bending processes), the control system determines a manipulation process or routine. In determining the manipulation routine, the control system 200 evaluates the measurements of the component 10 taken during the third step 1003 and determines a maximum displacement parameter or position for each datum 20*d* that corresponds to a bending holding device 120*d* and for each bending position 30 that corresponds to a bending device 130, for example, using one or more look-up tables and/or algorithms based on modeled component data (e.g., computer models and finite element analyses) and manufacturing data (e.g., learning for an individual run or lot of components, or larger number of components). Again, and as described above, the maximum displacement parameter position includes moving the corresponding datum 20*d* or bending location 30, relative to its measured position, to beyond the manufacture's required position (i.e., such that the component 10 relaxes and its elasticity moves the datum 20*d* or bending location 30 to within the manufacturer's requirements). The control system 200 may incorporate into the manipulation routine ramped actuation (i.e., having variable movement speed and/or hold times) and/or stepped actuation (i.e., alternating increased movement and force lessening for reaching the maximum displacement position).

The control system 200 may also determine a firing or actuation sequence for the manipulation routine. However, the actuation sequence may be predetermined, such that all manipulation routines for each different component 10 includes the same actuation sequence. The actuation sequence as actively determined by the control system 200 or as predetermined may be based, in part, on modeled data and/or manufacturing data.

Furthermore, the actuation sequence may include first actuating the bending holding device 120*d* before and in a different manner than actuating any bending devices 130. In particular, the bending routine may include actuating the bending holding device 120*d* to first move the corresponding datum 20*d* to a maximum displacement parameter (i.e., with or without ramped or stepped displacement), then move the datum 20*d* to within the manufacturer's requirements (e.g., either by allowing the component 10 to relax and/or actively moving the datum 20*d*), and then holding the datum 20*d* in this fixed location for the remaining duration of the bending routine.

In a fifth step 1005, the control system 200 executes the manipulation routine by moving the one or more bending holding devices 120*d* and the bending devices 130 according to the bending routine. In a first substep 1005*a*, the control system 200 causes the bending holding device 120*d* to move the corresponding datum 20*d* of the component 10 to its determined maximum displacement position, then hold the datum 20*d* at a fixed position with the manufacturer's specification and tolerance requirements for the component 10. After the first substep 1005*a*, in a series of at least five second substeps 1005*b*, the control system 200 causes the bending devices 130 to sequentially move the corresponding bending locations 30 of the component 10 to their determined maximum displacement positions. After the series of second sub steps 1005*b*, the control system 200 causes the bending holding device 120*d* to release the datum 20*d*.

After the fifth step 1005, step 1003 to measure the component 10 and step 1004 to assess the component 10 are repeated.

In a sixth step 1006, the component 10 is removed from the truing machine 100 (i.e., if the component 10 is assessed as being compliant according to substep 1004*a*, or is assessed to be discarded according to substep 1004*b*). And then the procedure begins again at step 1001 for a new component 10.

Although each of the steps 1001, 1002, 1003, 1004, 1005, and 1006 are described as first, second, third, etc. steps, it should be noted that the steps 1001, 1002, 1003, 1004, 1005, and 1006 may be performed in other orders, according to various exemplary embodiments.

According to an exemplary embodiment, a machine for bending a cast or stamped component into compliance with dimension and tolerance requirements includes a base and three fixed holding devices coupled to the base and configured to each hold one of three corresponding datums of each component of a series of components in a predetermined spatial orientation relative to the base. The machine further includes a bending device coupled to the base and configured to engage a corresponding bending position of each component of the series of components, and a control system. The control system is configured to cause the three fixed holding devices to hold the three datums of each component in the predetermined spatial orientation, perform a measurement of each component at the bending position, perform an assessment based on the measurement of whether the component satisfies a component specification, determine a bending routine based on the measurement for each component, and according to the bending routine for that component, cause the bending device to engage the component at the bending position to plastically bend the component into compliance with the component specification and to disengage the component.

According to an exemplary embodiment, the machine further includes a bending holding device corresponding to a fourth datum of each component, wherein the control system is configured cause according to the bending routine the three fixed holding devices to hold the three datums in the predetermined spatial orientation and simultaneously cause the bending holding device to engage the component at the fourth datum to plastically bend the component into compliance with the component specification and to hold the fourth datum in a position in compliance with the component specification.

According to an exemplary embodiment, the machine further includes three additional bending devices coupled to the base and configured to engage one of three additional corresponding bending positions of each component, wherein the control system is configured to cause according to the bending routine the three fixed holding devices to hold the three datums in the predetermined spatial orientation and simultaneously cause each of the three additional bending devices to engage the component at the corresponding bending position to plastically bend the component into compliance with the component specification and to disengage the component.

According to an exemplary embodiment, the first bending position and the three additional bending positions are each located about an outer periphery of the component. According to another exemplary embodiment, at least one of the first bending position or the three additional bending positions is located about an inner periphery of the component.

According to an exemplary embodiment, in determining the bending routine, the control system includes determining a displacement parameter for the each bending position, and in executing the bending routine, the control system causes each bending device to displace the corresponding bending position of the component a distance equal to the displacement parameter away from the measurement the bending position. According to another exemplary embodiment, each displacement parameter is greater than a distance between the measurement of the bending position and specification compliant position. According to another exemplary embodiment, in executing the bending routine, the control system causes each bending device to displace the corresponding bending position in a stepped manner. According to another exemplary embodiment, wherein in executing the bending routine, the control system causes each bending device to hold the corresponding bending position of the component for a predefined duration. According to another exemplary embodiment, in executing the bending routine, the control system causes the bending devices to engage the corresponding bending positions of the component sequentially.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A machine for bending a cast or stamped component into compliance with dimension and tolerance requirements, the machine comprising:

a base for holding the component;

a control system configured to:

collect measurements, relative to a fixed coordinate system defined by the base, of locations of at least one holding datum, at least one bending datum, and at least one articulating datum of the component by identifying the locations of the at least one holding datum, at least one bending datum, and at least one articulating datum of the component;

evaluate the measured locations for compliance with predetermined dimensional requirements by comparing each of the measured locations with a corresponding location of a model component;

determine a manipulation routine responsive to noncompliance of the measured locations with the predetermined dimensional requirements by determining that a deviation between at least one of the measured locations and the corresponding location of the model component is outside of a predetermined range; and control a tool or fitting to correct the noncompliance by moving at least one of the at least one bending datum and the at least one articulating datum relative to the at least one holding datum that is fixed in place during the manipulation routine and deforming the component into compliance with the predetermined dimensional requirements.

2. The machine according to claim 1, wherein the control system is configured to move the at least one articulating datum and the at least one bending datum sequentially.

3. The machine according to claim 1, wherein the at least one holding datum comprises first, second, and third holding datums; and wherein the first, second, and third holding datums and the at least one articulating datum are positioned proximate to an outer periphery of the component.

4. The machine according to claim 3, wherein the at least one bending datum includes four bending datums, each bending datum corresponding to a bending location disposed proximate to the outer periphery of the component, between any of the first, second, and third fixed holding datums and the at least one articulating datum, and wherein the control system is configured to control the tool or fitting to move each of the articulating datums during the manipulation routine.

5. The machine according to claim 4, wherein the control system determines a maximum displacement parameter for each of the bending locations and the at least one articulating datum, such that the component is plastically deformed during the manipulation routine.

6. The machine according to claim 1, wherein at least one bending location is disposed proximate to an inner periphery defining a central aperture in the component.

7. A method of truing a stamped or casted component for a vehicle, comprising:

receiving the component in a truing machine;

clamping the component at first, second, and third datums in a known spatial orientation;

measuring a fourth datum of the component to produce measurements by identifying a location of the fourth datum;

evaluating the measurements for compliance with predetermined dimensional requirements by comparing the measured location of the fourth datum with a corresponding location of a model component;

clamping the fourth datum in a position in compliance with the dimensional requirements;

determining, based on the measurements, a manipulation routine by determining that a deviation between the measured location of the fourth datum and the corresponding location of the model component is outside of a predetermined range;

performing the manipulation routine to move at least one of the first, second, third, or fourth datums to deform the component to bring the component within the dimensional requirements;

measuring a bending location of the component; and performing an additional manipulation routine if such measurements are not in compliance with the dimensional requirements.

8. The method according to claim 7, further comprising moving the fourth datum to a target location.

9. The method according to claim 8, further comprising determining a maximum displacement parameter for the fourth datum, such that performing the manipulation routine comprises moving the fourth datum to a maximum displacement based on the maximum displacement parameter resulting in plastic deformation of the component.

10. The method according to claim 7, further comprising moving a plurality of bending locations on the component.

11. The method according to claim 10, further comprising determining maximum displacement parameters for each of the plurality of bending locations, such that movement of the plurality of bending locations to maximum displacements based on the maximum displacement parameters results in plastic deformation of the component.

12. The method according to claim 10, wherein the manipulation routine further comprises determining an actuation sequence for a plurality of datums based on modeled data.

13. The method according to claim 10, wherein the manipulation routine further comprises determining an actuation sequence for a plurality of datums based on collected manufacturing data comprising trends from one or more previous manipulation routines.

14. The method according to claim 7, further comprising discarding the component if the component is not in compliance with the dimensional requirements after a predetermined number of additional manipulation routines are performed.

15. The method according to claim 7, further comprising performing an additional manipulation routine based on a throughput and scrap target.

16. The method according to claim 7, wherein the manipulation routine is defined by a total displacement of a plurality of datums.

* * * * *